US011987919B2

(12) United States Patent
Bagley

(10) Patent No.: US 11,987,919 B2
(45) Date of Patent: May 21, 2024

(54) TABLETOP SEWING FRAME

(71) Applicant: Gracewood Management, Inc., West Valley City, UT (US)

(72) Inventor: Jim Matthews Bagley, West Valley City, UT (US)

(73) Assignee: GRACEWOOD MANAGEMENT, INC., West Valley City, UT (US)

( * ) Notice: Subject to any disclaimer, the term of this patent is extended or adjusted under 35 U.S.C. 154(b) by 83 days.

(21) Appl. No.: 17/491,118

(22) Filed: Sep. 30, 2021

(65) Prior Publication Data

US 2022/0098772 A1 Mar. 31, 2022

Related U.S. Application Data

(60) Provisional application No. 63/085,448, filed on Sep. 30, 2020.

(51) Int. Cl.
*D05B 75/06* (2006.01)
*D05B 77/00* (2006.01)
*D05C 9/04* (2006.01)

(52) U.S. Cl.
CPC ..... *D05B 75/06* (2013.01); *D05C 9/04* (2013.01); *D05B 77/00* (2013.01)

(58) Field of Classification Search
CPC ..... A47B 29/00; A47B 13/02; D05C 9/04; D05C 9/22; D05B 75/00; D05B 75/06; D05B 39/005; D05B 39/00; D05B 11/00
USPC ..... 108/50.01, 50.11; 52/655.1
See application file for complete search history.

(56) References Cited

U.S. PATENT DOCUMENTS 806,485 A * 12/1905 Parker ..... A47B 35/00 211/208
872,498 A * 12/1907 Cleveland ..... A47B 23/046 108/146
2,165,496 A * 7/1939 Mccall ..... D05B 39/005 24/535
2,206,774 A * 7/1940 Hallowell ..... D05B 75/02 D15/74
3,410,232 A * 11/1968 Bills ..... A47B 9/14 108/146
3,787,968 A * 1/1974 Littmann ..... B26D 1/025 83/454
4,655,426 A * 4/1987 von Dulong ..... F16M 11/28 248/405
5,423,502 A * 6/1995 Thomason ..... A47B 9/06 248/188.4
5,479,852 A * 1/1996 Lloyd ..... A47B 9/14 108/146

(Continued)

OTHER PUBLICATIONS

Grace Company, Q-Zone Hoop-Frame Assembly, Jan. 8, 2019, YouTube (https://www.youtube.com/watch?v=_RSovj4xhcY), last accessed Jul. 11, 2023. (Year: 2019).*

*Primary Examiner* — Patrick J. Lynch
(74) *Attorney, Agent, or Firm* — Ryan L. Marshall; Jessica Kiser; Barnes & Thornburg LLP

(57) ABSTRACT

A sewing frame unit includes a frame support structure and a frame assembly. The frame assembly includes a front fabric retainer, a rear fabric retainer, a first end retainer, and a second end retainer. The front fabric, rear fabric, first end, and second end retainers are each affixed to the frame support structure. Each end of the rear fabric retainer engages a quick release housing.

16 Claims, 8 Drawing Sheets

(56) References Cited

U.S. PATENT DOCUMENTS

| | | | | |
|---|---|---|---|---|
| 5,562,052 | A * | 10/1996 | Glashouwer | A47B 9/14 108/1 |
| 6,990,914 | B2 * | 1/2006 | Canan | D05B 11/00 112/119 |
| D549,494 | S * | 8/2007 | Waner | D6/709 |
| 9,109,313 | B2 | 8/2015 | Bagley | |
| 9,273,421 | B2 | 3/2016 | Bagley | |
| 9,476,151 | B2 | 10/2016 | Bagley | |
| 9,648,949 | B1 * | 5/2017 | Penaflor | B65B 45/00 |
| 10,889,930 | B2 | 1/2021 | Bagley | |
| 2003/0079666 | A1 * | 5/2003 | Barrus | D05B 11/00 112/117 |
| 2007/0040482 | A1 * | 2/2007 | Williams | A47B 9/10 312/21 |
| 2013/0156492 | A1 * | 6/2013 | Maier | B62J 1/08 403/109.1 |
| 2015/0114272 | A1 * | 4/2015 | Bagley | D05B 39/005 112/475.08 |
| 2016/0270496 | A1 * | 9/2016 | Pitchforth | B62B 1/12 |
| 2017/0189736 | A1 * | 7/2017 | Martin | E04H 12/22 |
| 2017/0259153 | A1 * | 9/2017 | Fiedler | A63B 69/385 |
| 2021/0131000 | A1 | 5/2021 | Bagley | |
| 2022/0025564 | A1 | 1/2022 | Bagley | |

* cited by examiner

TABLETOP SEWING FRAME

RELATED APPLICATIONS

This application is a U.S. Non-provisional application claiming priority under 35 U.S.C. 120 and 119(e) to U.S. provisional application No. 63/085,448, filed Sep. 30, 2020. The disclosure of this priority application is incorporated herein in its entirety.

BACKGROUND

The present invention is in the field of devices and methods for sewing, and, in particular, in the field of sewing frames and other devices and methods for the positioning and retention of fabric for sewing with a tabletop, sewing machine.

Devices for machine quilting typically consist of three primary components, a frame, a sewing machine, and a machine carriage having a carriage bottom plate that travels laterally on an x-axis and a carriage top plate that travels longitudinally on a y-axis. Fabric layers, that typically consist of backing fabric, batting, and top fabric, may consist of as few as one layer of fabric or more than three layers, which single fabric layer, or multiple layers collectively, referred to in this application as a "quilt core." The term "fabric layers" when used in this application, shall be defined to include a single layer of fabric. The fabric layers are rolled onto fabric layer rails and fed from the respective fabric layer rails to a take-up rail that passes through the throat of the sewing machine, suspending the fabric layers of the quilt core together to rest on the sewing machine bed. In order for the fabric layers of the quilt core to remain flat and straight, it is necessary for the fabric layer rails and the take-up rail to be longer than the quilt is wide.

For a typical quilting frame, the sewing machine is positioned on and secured to the quilting frame carriage top plate and is guided on the machine carriage to create a desired stitching pattern as the layers of fabric are quilted together. The sewing machine is guided longitudinally and laterally across the available quilting work area, which is determined by the length of the throat of the sewing machine and the width of the quilt fabric itself, the width of the quilt being limited to the width of the quilting frame.

When the fabric in the work area has been sewn, the fabric is rolled forward from the fabric layer rails to the take-up rail so that the completed area is rolled onto the take-up rail that passes through the throat of the sewing machine. This also advances the fabric that has not yet been quilted into the work area and the new strip of un-quilted fabric area may then be sewn. A typical quilting frame requires that the quilt be sewed from front to back, or vice versa, with the fabric progressively being fed onto the take-up rail as each strip of the quilt core is sewed from one side of the quilt core to the other.

An alternative to machine quilting with a traditional frame is to quilt by hand, performing all the stitching without a sewing machine, simply using a needle and thread. Another alternative is to baste the three layers of fabric together using pins or small stitches later to be removed. Once the fabric is basted, the user can quilt the layers together by guiding the fabric through the machine by hand. Hoops may also used to hold small areas of the quilt flat and straight to perform the stitching. Embroidery machines, for example, use a hoop to hold the fabric and then through motor control, move the hoop while the sewing machine stitches to create the desired patterns on the fabric.

Sewing without a frame requires basting, which is time consuming. Hand quilting or quilting by using a hoop also requires basting, and moving the fabric to create the sewing patterns can be cumbersome due to the amount of fabric that has to be manipulated in a large quilt. Sewing and/or Machine quilting on a frame is a much more convenient and expeditious way to complete a quilt. Machine quilting on a frame requires a large frame, however, to make large quilts. Many quilters do not have enough space to accommodate the large quilting frame.

SUMMARY

A sewing frame unit is provided. The sewing frame unit includes a frame support structure and a frame assembly. The frame assembly includes a front fabric retainer, a rear fabric retainer, a first end retainer, and a second end retainer. The front fabric, rear fabric, first end, and second end retainers are each affixed to the frame support structure, each end of the rear fabric retainer engages a first quick release housing and a second quick release housing, the first and second quick release housings each include a cap to secure each end of the rear fabric retainer in the first and second quick release housings. The sewing frame includes a first front retainer support member and a second front retainer support member each affixed to the frame support structure and to the front fabric retainer; and a first rear retainer support member and a second rear retainer support member each affixed to the frame support structure and each removably secured to the rear fabric retainer. The sewing frame includes a machine carriage assembly mounted on the frame support structure. The machine carriage assembly provides for lateral and longitudinal movement of the sewing machine.

In some aspects, the first and second front retainer support members each comprise an inner support member having a plurality of positions that engage a pin for adjusting a height of the respective first and second front retainer support members.

In some aspects, the first and second rear retainer support members each have an inner support member comprising a plurality of positions that engage a pin for adjusting a height of the respective first and second rear retainer support members.

In some aspects, the pin is operably connected to a cam lever for disengaging and engaging the pin with a position on the inner support member.

In some aspects, the plurality of positions are a plurality of teeth.

In some aspects, the first and second quick release housings each comprise grooves that guide a lip on the cap.

In some aspects, the machine carriage assembly further comprises a front carriage track, a rear carriage track, a lateral carriage element, and a pair of longitudinal tracks on the lateral carriage element.

In some aspects, the machine carriage assembly comprises front carriage rollers and rear carriage rollers mounted to the lateral carriage element.

In some aspects, the machine carriage assembly comprises a wheeled base comprising rollers that engage the pair of longitudinal tracks.

In some aspects, one or more of the front fabric retainer, the first end retainer, and the second end retainer have a fabric tightening mechanism.

In some aspects, each fabric tightening mechanism has a ratchet drive.

In some aspects, the sewing frame unit includes a plurality of retainer clips.

In some aspects, the sewing frame unit includes a foam attached to the frame support structure and configured to contact a tabletop.

A method for sewing by a user with a sewing machine of a quilt core comprised of one or more fabric layers, using a sewing frame unit and without the use of a full width sewing frame is provided. The method includes removing a rear fabric retainer from a first quick release housing and a second quick release housing; mounting the sewing machine on a machine carriage assembly, the machine carriage assembly being supported by a frame support structure; securing rear fabric retainer in the first quick release housing and the second quick release housing; sequentially securing respective fabric zones of the fabric core in a sewing frame assembly, the sewing frame assembly being supported by and positioned by the frame support structure, the sewing frame assembly comprising a front fabric retainer, the rear fabric retainer, a first end retainer, a second end retainer; and sewing respective pattern segments in each fabric zone sequentially, the machine carriage assembly providing for the quilting machine to be moved laterally and longitudinally by the user for sewing the pattern segments.

In some aspects, the pin is operably connected to a cam lever for disengaging and engaging the pin with a position on the inner support member.

DETAILED DESCRIPTION

As used herein "sewing frame" refers to a support structure for stitching fabric or other materials together. An example of a sewing frame is a quilting frame for sewing layers of fabric together.

Figure 1:
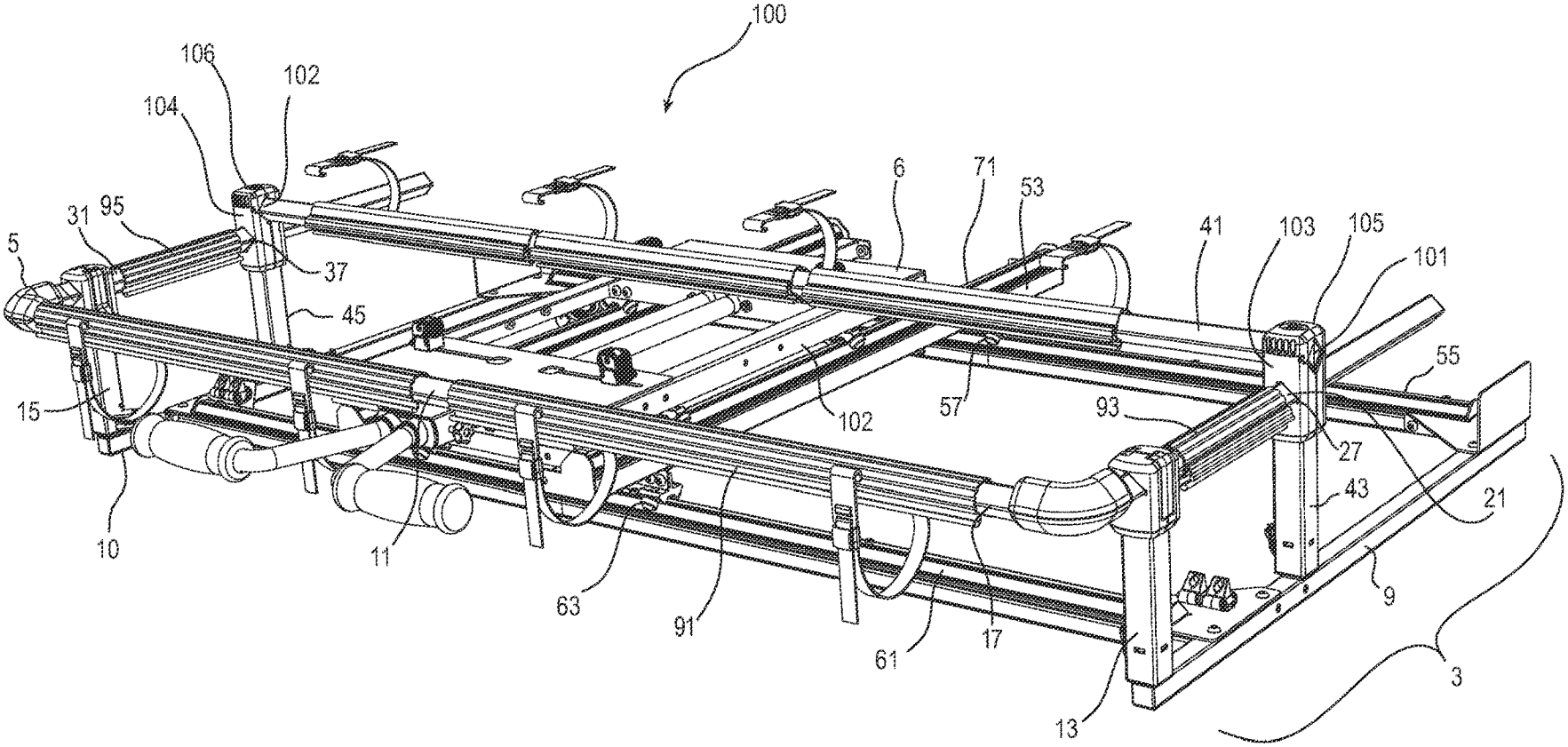
FIG. 1 is a perspective view of an embodiment of a tabletop sewing frame unit.

Referring first to FIG. 1, a front perspective view of an embodiment of a hoop frame unit 100. For the embodiment shown, the hoop frame unit 100 is comprised of a frame support structure 3, a hoop frame assembly 5, and a machine carriage assembly 6. For the embodiment shown, the frame support structure 3 is comprised of a first frame end 9 and a second frame end 10. Other variations and designs for the frame support structure 3 for supporting, stabilizing and positioning the frame assembly 5, and providing workable access to the frame assembly 5, will be known to persons ordinarily skilled in the art, in view of the disclosures of the specification and drawings presented. Various materials known to persons skilled in the art may be used for the frame support structure 3, which will provide the desired structural strength, durability, functionality, economy and appearance.

The hoop frame assembly 5, for embodiment shown, is comprised of a front fabric retainer 11, a rear fabric retainer 41, a first end retainer 21, and a second end retainer 31. The front fabric retainer 11 is secured to the first frame end member 9 by first front retainer support member 13 and is secured to the second frame end member 10 by a second front retainer support member 15. The first end fabric retainer 21 is affixed to the first frame end member 9 by first front retainer support member 13. Likewise the second end fabric retainer 31 is affixed to the second frame end member 10 by a second front retainer support member 15. The rear fabric retainer 41 is affixed to the first frame end member 9 by first rear retainer support member 43 and is affixed to the second frame end member 10 by the second rear retainer support member 45. Other variations and designs for the hoop frame assembly 5, providing for variations in the connection of the hoop frame assembly components to the frame support structure 3 and for supporting, stabilizing and positioning the frame assembly 5, will be known to persons ordinarily skilled in the art, in view of the disclosures of the specification and drawings presented.

Figure 5:
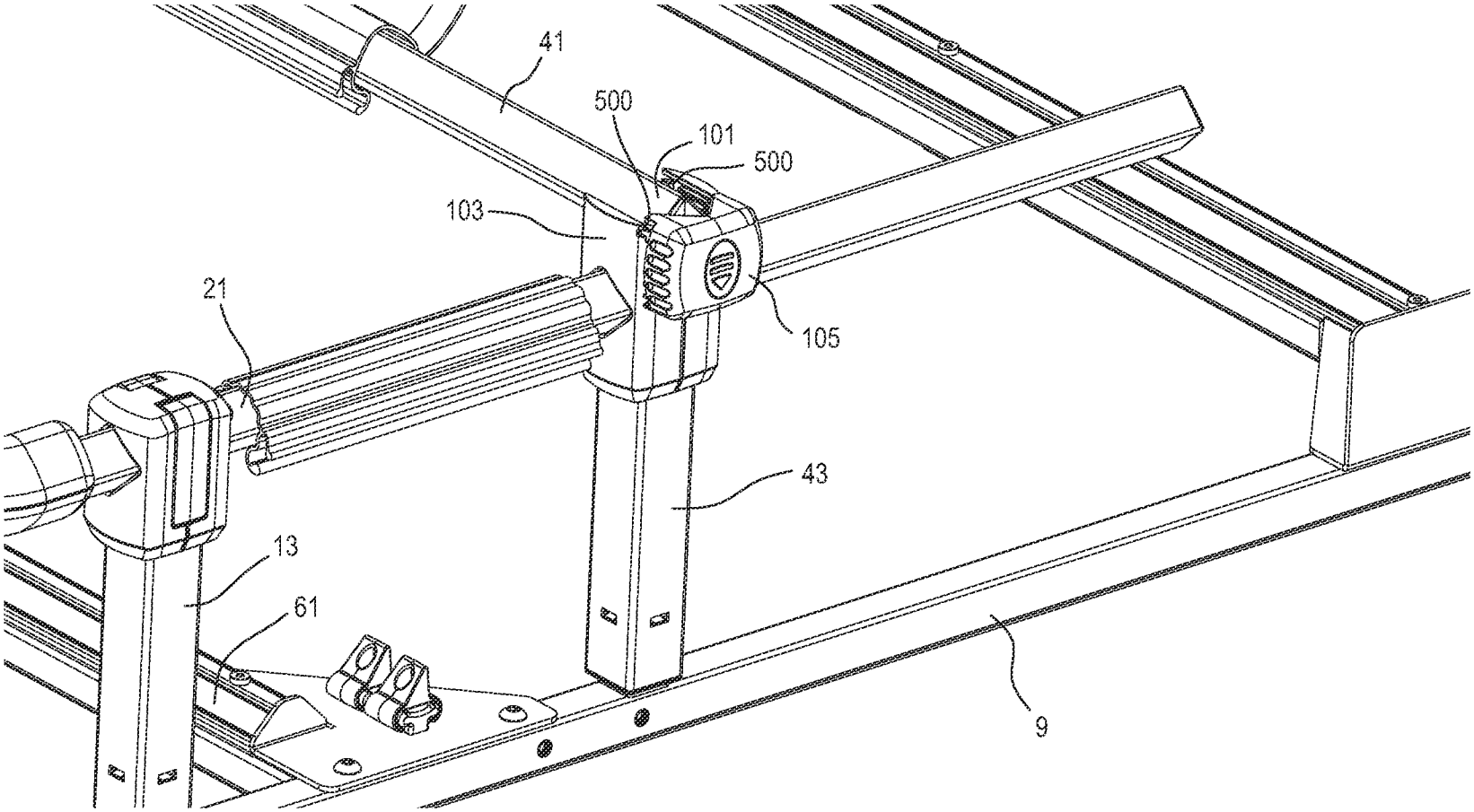
FIG. 5 is a perspective view of an embodiment of a tabletop sewing frame unit with the cap of the quick release housing in the open position.

The machine carriage assembly 6 is supported by a front carriage track 61 and a rear carriage track 55 which are affixed on opposing ends into the first frame end 9 and the second frame end 10. For the embodiment shown, front carriage rollers 63 and rear carriage rollers 57 provide for lateral carriage movement 65, and thus for the machine lateral movement 100 of a sewing machine 101 as shown in FIG. 5. The embodiment of the machine carriage assembly 6 shown in FIG. 1 incorporates a lateral carriage element 53 to which the carriage rollers 63, 57 are affixed, which provide for the machine carriage assembly 6 to accomplish carriage lateral movement, and a pair of longitudinal tracks 71, which for the embodiment shown in FIG. 1, provide for a sewing machine with an integral wheeled base 102 or a separate wheeled machine base to which a sewing machine may removably mounted, to provide for machine longitudinal movement on the longitudinal tracks 71 on the carriage lateral element 53. Whether the sewing machine itself or the sewing machine mounted on a separate wheeled machine base, is positioned on the longitudinal tracks 71, the sewing machine is free rolling upon the lateral carriage element 53 thereby providing for machine longitudinal movement concurrently with the carriage lateral movement provided by the carriage lateral element 53. The machine carriage assembly 6, therefore provides for machine lateral movement and machine longitudinal movement for a sewing machine mounted on the machine carriage assembly 6.

The front fabric 11, rear fabric 41, first end 21, and second end retainers 31 are each affixed to the frame support structure 3, each end 101, 102 of the rear fabric retainer 41 engages a first quick release housing 103 and a second quick release housing 104, the first 103 and second 104 quick release housings each include a cap 105, 106 to secure each end 101, 102 of the rear fabric retainer 41 in the first and second quick release housings 103, 104.

Figure 2:
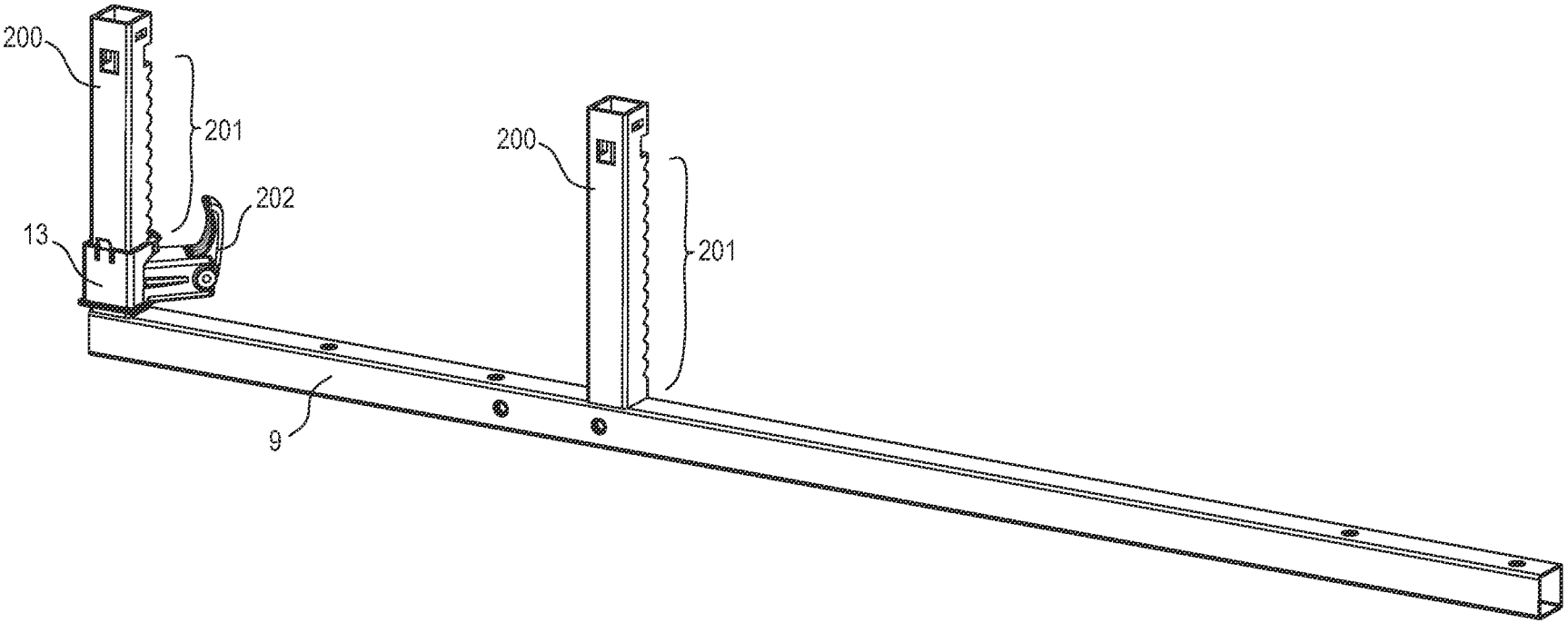
FIG. 2 is a cross-sectional view of an embodiment of a height adjustment mechanism.

Referring to FIG. 2, the first 13 and second front retainer support members 15 each comprise an inner support member 200 having a plurality of positions 201 that engage a pin for adjusting a height of the respective first and second front retainer support members 13, 15. The first 43 and second rear retainer support members 45 each have an inner support member 200 comprising a plurality of positions 201 that engage a pin for adjusting a height of the respective first 43 and second rear retainer support members 45. The pin (not shown) is operably connected to a cam lever 202 for disengaging and engaging the pin with a position 201 on the inner support member 200.

In some aspects, the plurality of positions are a plurality of teeth.

Figure 3:
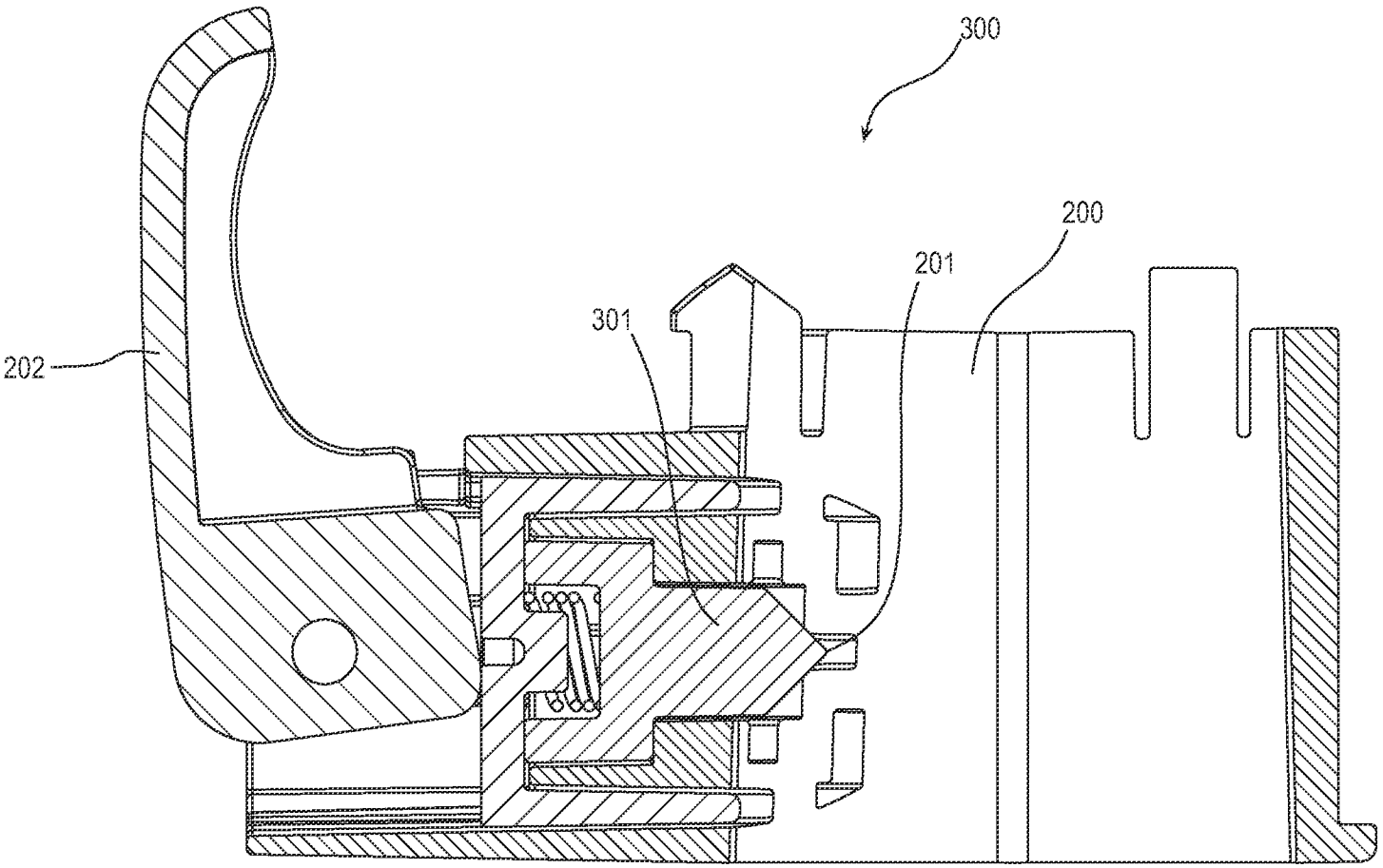
FIG. 3 is a perspective view of an embodiment of an inner support member and height adjustment mechanism.

FIG. 3 shows a cross sectional view of an embodiment of the height adjustment mechanism 300 where the cam lever 202 is operably connected to a pin 301 that engages a position 201 on an inner support member 200.

Figure 4:
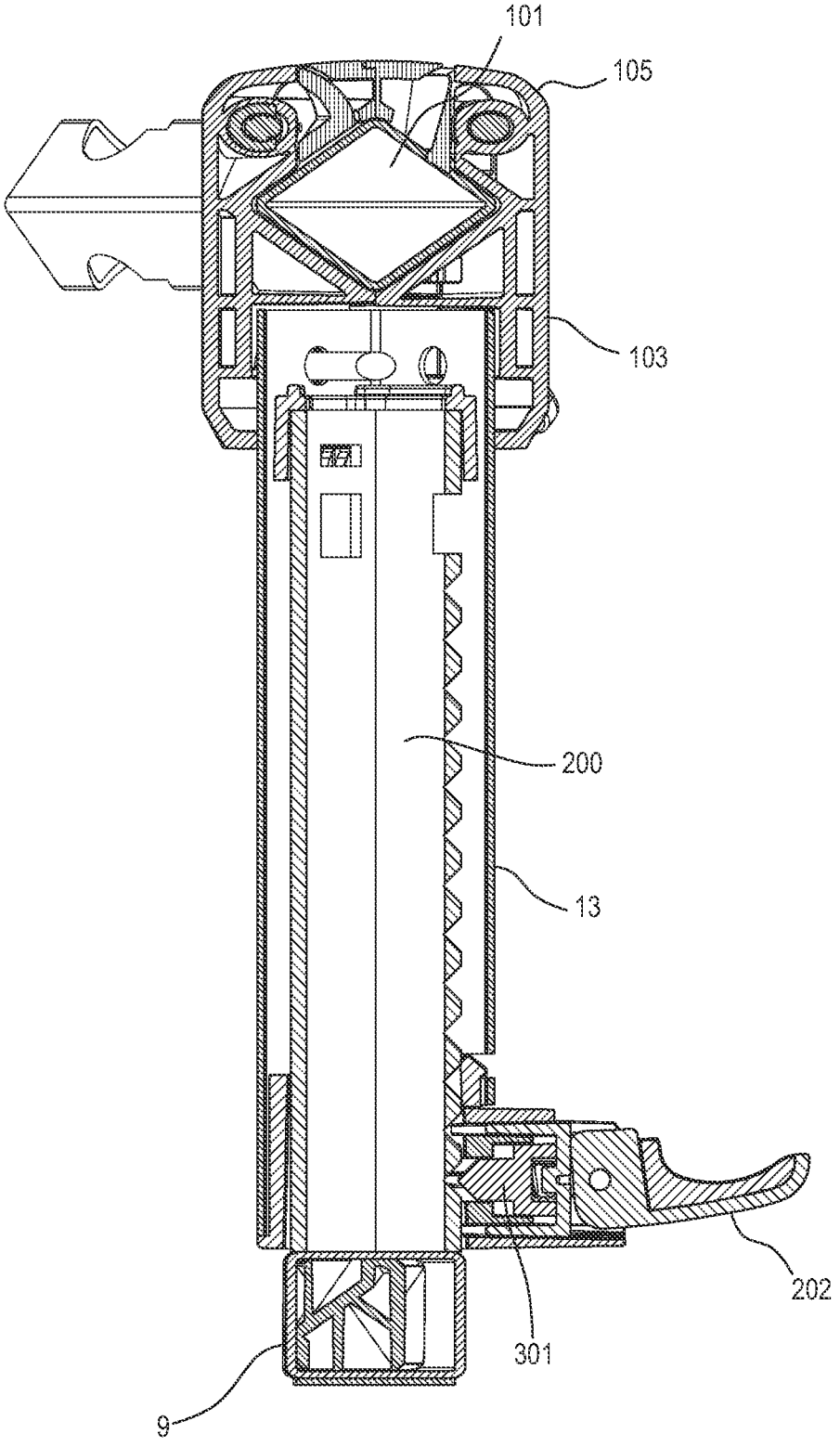
FIG. 4 is a cross-sectional view of an embodiment of an inner support member, height adjustment mechanism, and quick release housing.
Figure 7:
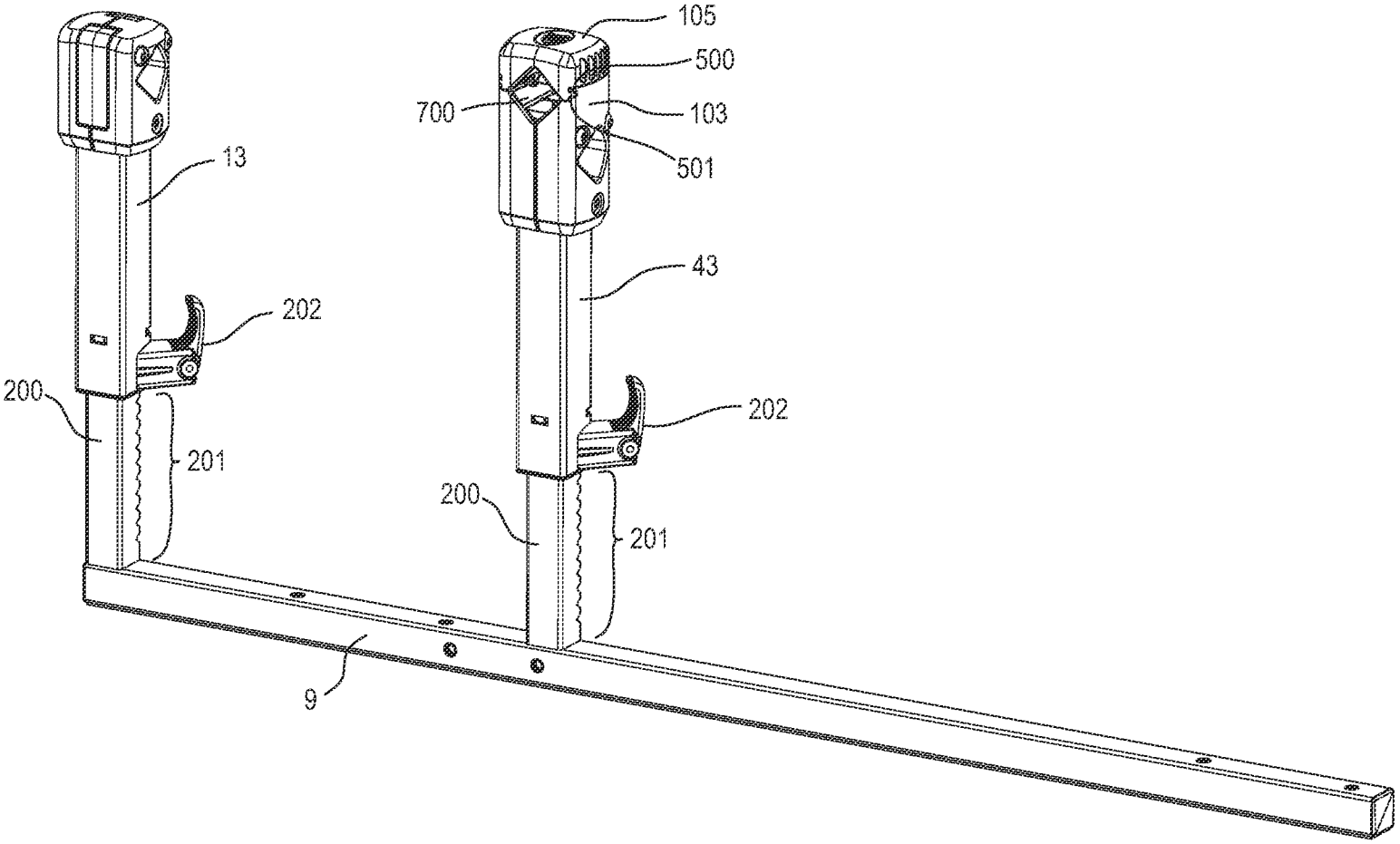
FIG. 7 is a perspective view of an embodiment of an inner support member, height adjustment mechanism, and quick release housing.

FIG. 4 is a cross-sectional view of an embodiment of an inner support member 200, height adjustment mechanism with cam lever 202 and pin 301, and quick release housing 103. The inner support member 200 can be position within the retainer support members. By engaging the pin 301 at a position on the inner support member 200, the retainer support member 13 can be raised and lowered. FIG. 7 shows that the retainer support members 13, 43 can be raised or lowered by selecting a position 201 on the inner support members 200.

Figure 6:
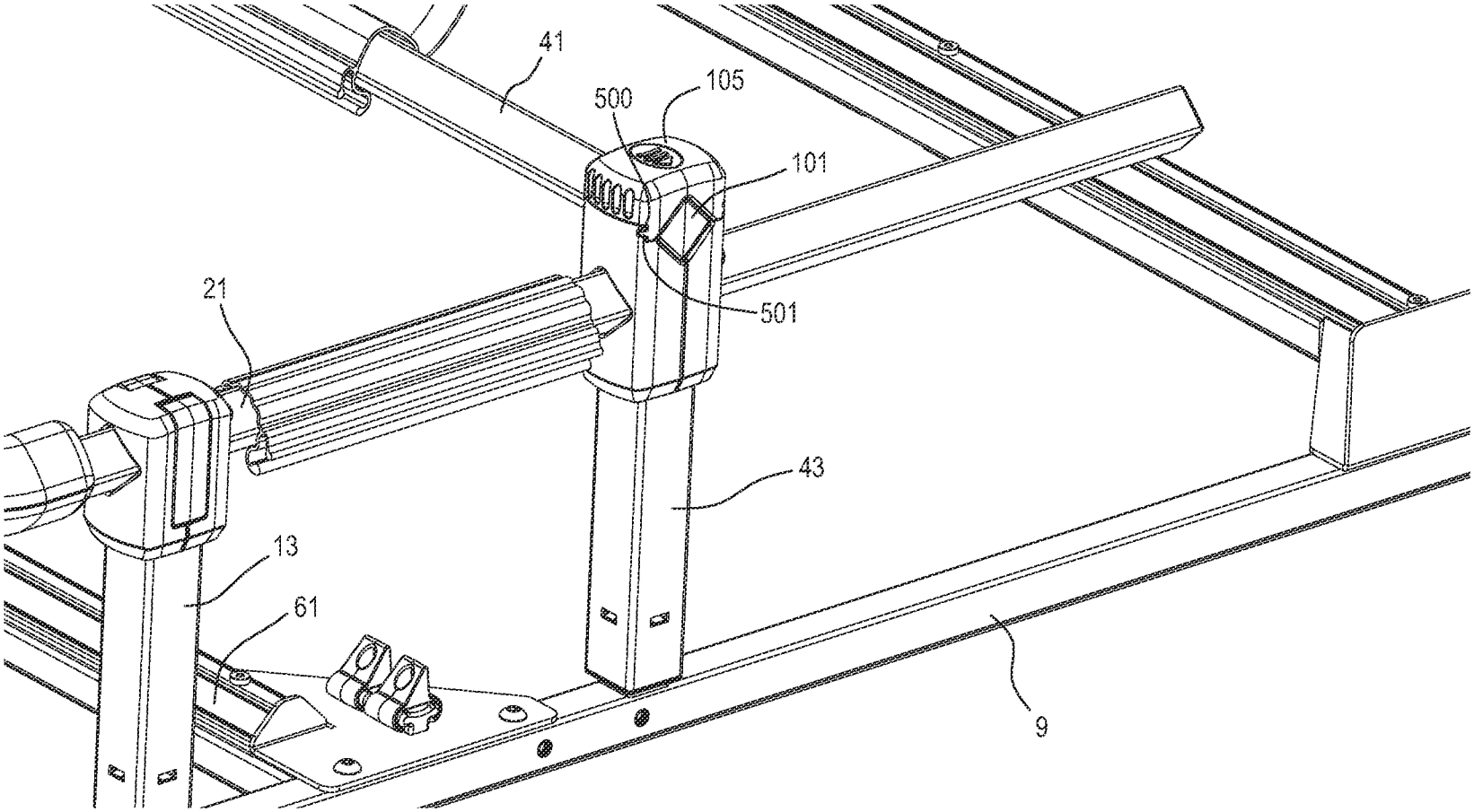
FIG. 6 is a perspective view of an embodiment of a tabletop sewing frame unit with the cap of the quick release housing in the closed position.

FIG. 5 shows an embodiment of the sewing from unit where the rear fabric retainer 41 is not secured in the quick release housing 103. The cap 105 is removable and includes a lip 501 that engages a groove 500 on the quick release housing 103. FIG. 6 shows an embodiment where the rear fabric retainer 41 is secured in the quick release housing 103 and the cap 105 is secured over the end 101 of the rear fabric retainer 41. As shown in FIGS. 6 and 7, the lip 501 on the cap 105 is received in the groove 500 so that the groove 500 guides the lip 501 of the cap 105.

Figure 8:
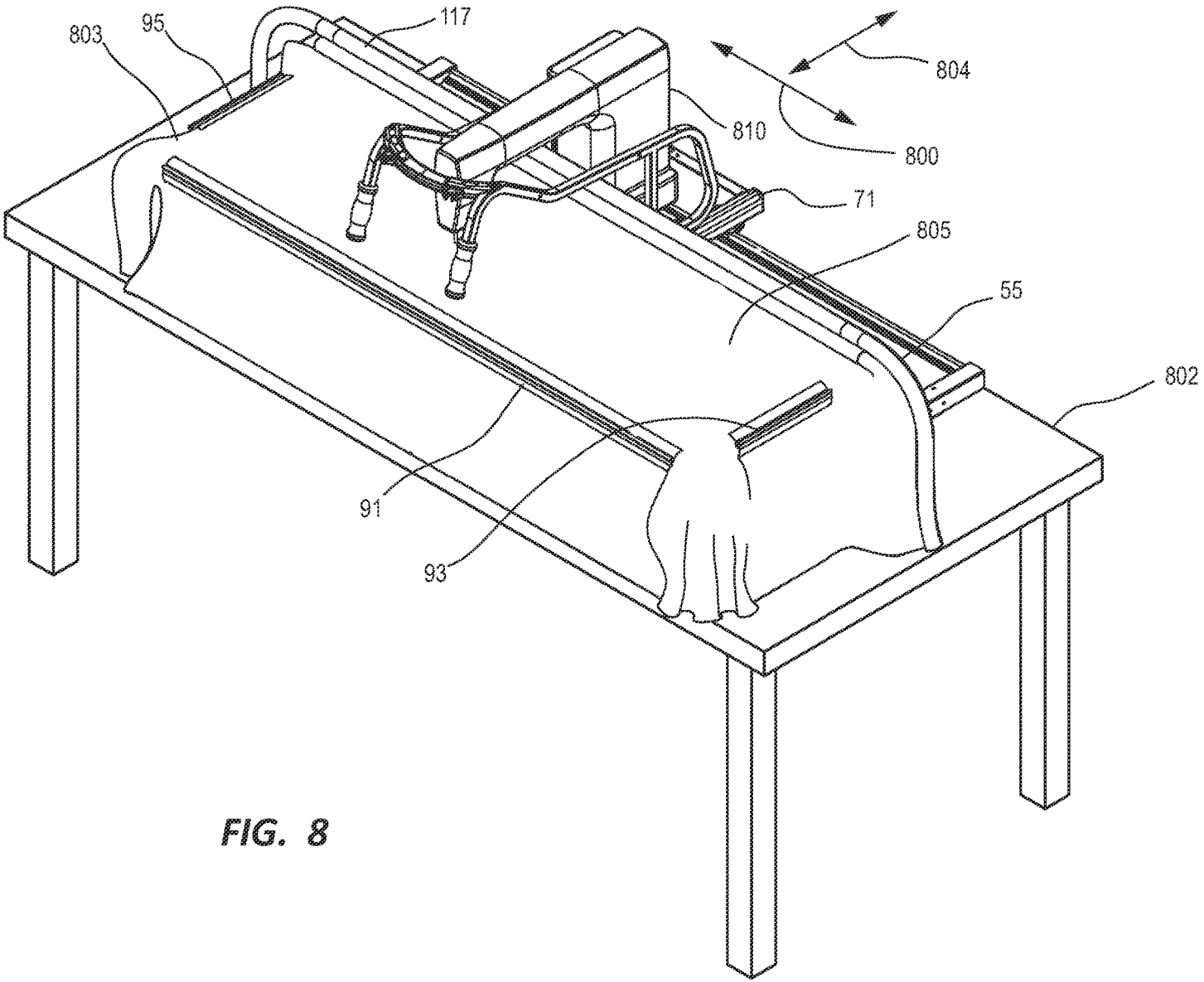
FIG. 8 is an end elevation view of an embodiment of a hoop frame assembly of a hoop frame unit with a quilt core in place on the hoop frame assembly and a fabric zone of the quilt core secured by fabric retainers and retainer clips of the hoop frame assembly, and with a quilting machine mounted on the machine carriage assembly.

Referring to FIGS. 1 and 8, the front fabric retainer 11 has a front retainer seat 17. The first end retainer 21 has a first end retainer seat 27 and the second end retainer 31 has a second end retainer seat 37. Referring now to FIG. 8, a front retainer clip 91 may be used to secure fabric to the front fabric retainer 11 by mating with the front retainer seat after the fabric core 803 is draped over the front fabric retainer 11. Likewise, a first end retainer clip 93 and a second end retainer clip 95 may be used to mate respectively with the first end retainer seat 27 and the second end retainer seat 37 after the fabric core 103 is draped over the respective end retainers 21, 31 as shown in FIG. 8. As shown in FIGS. 1 and 8, one or more of the front fabric retainer 11, the first end retainer 21, and the second end retainer 31 have a fabric tightening mechanism 91, 93, 95. As shown in FIGS. 1 and 8, the fabric tightening mechanism 91, 93, 95 is the retainer clip 91, 93, 95. In view of the disclosures of this specification and the drawings, alternative embodiments of the retainer seats and retainer clips for securing the fabric zones to the respective fabric retainers, other than that shown in the drawings of the present application, will be known to persons of skill in the art.

The fabric zone 805 is the portion of the fabric core 803 positioned between the front fabric retainer 11, the first end retainer 21, the second end retainer 31, and the rear fabric retainer 41, after the respective retainer clips 91, 93, and 95, are secured in place for sewing as shown in FIG. 8.

When the fabric core 803 is secured and the selected fabric zone 805 is in place as shown in FIG. 8, the sewing machine 801 may be operated by the user to sew the desired sewing pattern in the fabric zone 805. Once the sewing of the fabric zone 805 is completed, the retainer clips, 91, 93, and 95 may be removed from the fabric core 803 and the fabric moved and then re-secured, presenting another selected fabric zone 805 for sewing by the user. The hoop frame unit 100 and the hoop frame assembly 5 of the present application provide for complete flexibility in the sequencing of the sewing of the respective fabric zones 805. A typical sewing frame requires that the fabric be sewed from front to back, or vice versa, with the fabric progressively being fed onto a take-up rail as each strip of the fabric core is sewed from one side of the fabric core to the other. The hoop frame unit 100 and the hoop frame assembly 5 of the present invention, on the other hand, provide for the fabric core to be re-positioned laterally, longitudinally or diagonally, or to be rotated to any extent desired by the user. When sewing is completed on a fabric zone 805, the user has complete flexibility to re-position the fabric core as desired for the convenience or preference of the user as the user progresses from one fabric zone 805 to another. The user can sequence the sewing of the fabric zones as desired and can overlap respective fabric zones 805 on any side, in any direction, and to any extent desired.

In some aspects, the sewing frame unit includes a foam attached to the frame support structure and configured to contact a tabletop. The foam may be a non-skid foam. A non-skid foam can be any foam that prevents motion of the sewing frame unit on the surface of the table. Other materials besides foam may be used so that the sewing frame unit sits motionless on a table-top or other surface on which the sewing frame unit is resting. The foam at the base of the unit replaces the need for having a clamp to attach the unit to the table.

A method for sewing by a user with a sewing machine of a quilt core comprised of one or more fabric layers, using a sewing frame unit and without the use of a full width sewing frame is provided. The method includes removing a rear fabric retainer from a first quick release housing and a second quick release housing; mounting the sewing machine on a machine carriage assembly, the machine carriage assembly being supported by a frame support structure; securing rear fabric retainer in the first quick release housing and the second quick release housing; sequentially securing respective fabric zones of the fabric core in a sewing frame assembly, the sewing frame assembly being supported by and positioned by the frame support structure, the sewing frame assembly comprising a front fabric retainer, the rear fabric retainer, a first end retainer, a second end retainer; and sewing respective pattern segments in each fabric zone sequentially, the machine carriage assembly providing for the quilting machine to be moved laterally and longitudinally by the user for sewing the pattern segments.

In view of the disclosures of this specification and the drawings, other embodiments and other variations and modifications of the embodiments described above will be obvious to a person skilled in the art. Therefore, the foregoing is intended to be merely illustrative of the invention and the invention is limited only by the following claims and the doctrine of equivalents.

What is claimed is:

1. A sewing frame unit, comprising:

a frame support structure;

a frame assembly comprising a front fabric retainer that extends laterally relative to a lateral axis, a rear fabric retainer that extends laterally relative to the lateral axis, a first end retainer that extends longitudinally relative to a longitudinal axis perpendicular to the lateral axis, and a second end retainer that extends longitudinally relative to the longitudinal axis, wherein the front fabric, rear fabric, first end, and second end retainers are each affixed to the frame support structure, and wherein each end of the rear fabric retainer engages a quick release housing, each quick release housing comprises a housing body and a cap to secure the respective end of the rear fabric retainer in the housing body of the respective quick release housing, a first front retainer support member and a second front retainer support member are each affixed to the frame support structure and to the front fabric retainer;

a first rear retainer support member and a second rear retainer support member are each affixed to the frame support structure and each removably secured to the rear fabric retainer;

a machine carriage assembly mounted on the frame support structure, the machine carriage assembly providing for lateral and longitudinal movement of a sewing machine;

wherein the cap of each quick release housing is configured to slide laterally between an open position in which the cap of the respective quick release housing is spaced apart from the respective end of the rear fabric retainer to allow the rear fabric retainer to move relative to the frame support structure and a closed position in which the cap of the respective quick release housing extends over the respective end of the rear fabric retainer to block movement of the rear fabric retainer relative to the frame support structure, wherein the housing body of each quick release housing comprises a groove that extends laterally through an outer face of the housing body and the cap of each quick release housing comprises a lip received in the groove so that the groove guides the cap as the cap laterally slides between the open position and the closed position.

2. The sewing frame unit of claim 1, wherein the first and second front retainer support members each comprise an inner support member having a plurality of positions that engage a pin for adjusting a height of the respective first and second front retainer support members.

3. The sewing frame unit of claim 1, wherein the first and second rear retainer support members each have an inner support member comprising a plurality of positions that engage a pin for adjusting a height of the respective first and second rear retainer support members.

4. The sewing frame unit of claim 2, wherein the pin is operably connected to a cam lever for disengaging and engaging the pin with a position on the inner support member.

5. The sewing frame unit of claim 2, wherein the plurality of positions are a plurality of teeth.

6. The sewing frame unit of claim 1, wherein the machine carriage assembly further comprises a front carriage track, a rear carriage track, a lateral carriage element, and a pair of longitudinal tracks on the lateral carriage element.

7. The sewing frame unit of claim 6, wherein the machine carriage assembly comprises front carriage rollers and rear carriage rollers mounted to the lateral carriage element.

8. The sewing frame unit of claim 1, wherein the machine carriage assembly comprises a wheeled base comprising rollers that engage a pair of longitudinal tracks.

9. The sewing frame unit of claim 1, wherein one or more of the front fabric retainer, the first end retainer, and the second end retainer have a fabric tightening mechanism.

10. The sewing frame unit of claim 1, further comprising a plurality of retainer clips.

11. The sewing frame unit of claim 1, further comprising a non-skid foam attached to the frame support structure and configured to contact a tabletop.

12. A sewing frame unit, comprising:

a frame support structure;

a frame assembly comprising a front fabric retainer that extends laterally relative to a lateral axis, a rear fabric retainer that extends laterally relative to the lateral axis, a first end retainer that extends longitudinally relative to a longitudinal axis perpendicular to the lateral axis, and a second end retainer that extends longitudinally relative to the longitudinal axis, wherein the front fabric, rear fabric, first end, and second end retainers are each affixed to the frame support structure;

a first quick release housing coupled to the frame support structure;

a second quick release housing coupled to the frame support structure;

wherein a first end of the rear fabric retainer engages the first quick release housing and a second end of the rear fabric retainer engages the second quick release housing;

wherein the first and second quick release housings each comprise a housing body and a cap coupled to the housing body to laterally slide between an open position in which the cap is spaced apart from the respective end of the rear fabric retainer to allow the rear fabric retainer to move relative to the frame support structure and a closed position in which the cap extends over the respective end of the rear fabric retainer to block movement of the rear fabric retainer relative to the frame support structure; and wherein the housing body of each quick release housing comprises a groove that extends laterally through an outer face of the housing body and the cap of each quick release housing comprises a lip received in the groove so that the groove guides the cap as the cap laterally slides between the open position and the closed position.

13. The sewing frame unit of claim 12, further comprising:

a first front retainer support member that extends between and interconnects the frame support structure and to the front fabric retainer;

a second front retainer support member that extends between and interconnects the frame support structure and to the front fabric retainer;

a first rear retainer support member that extends between and interconnects the frame support structure and the first quick release housing; and a second rear retainer support member that extends between and interconnects the frame support structure and the second quick release housing;

wherein the first and second front retainer support members each comprise an inner support member having a plurality of positions that engage a pin for adjusting a height of the respective first and second front retainer support members.

14. The sewing frame unit of claim 13, wherein the first and second rear retainer support members each have an inner support member comprising a plurality of positions that engage a pin for adjusting a height of the respective first and second rear retainer support members.

15. The sewing frame unit of claim 14, wherein the pin is operably connected to a cam lever for disengaging and engaging the pin with a position on the inner support member.

16. The sewing frame unit of claim 15, wherein the plurality of positions are a plurality of teeth.

* * * * *